United States Patent [19]

Kirkpatrick et al.

[11] 4,316,403

[45] Feb. 23, 1982

[54] GUN BOLT FOR A HIGH RATE OF FIRE REVOLVING BATTERY GUN

[75] Inventors: Robert G. Kirkpatrick, Shelburne; Ronald R. Snyder, Georgia; Lincoln L. Sibley, Jr., Burlington, all of Vt.

[73] Assignee: General Electric Company, Burlington, Vt.

[21] Appl. No.: 118,025

[22] Filed: Feb. 4, 1980

[51] Int. Cl.[3] ..... F41D 7/02

[52] U.S. Cl. ..... 89/12

[58] Field of Search ..... 89/12, 13 R, 13 A, 127, 89/126

[56] References Cited

U.S. PATENT DOCUMENTS

| | | | |
|---|---|---|---|
| 125,563 | 4/1872 | Gatling | 89/12 |
| 2,849,921 | 9/1958 | Otto | 89/12 |
| 3,595,128 | 7/1971 | Hoyt | 89/12 |
| 3,611,871 | 10/1971 | Kirkpatrick et al. | 89/127 |
| 3,766,821 | 10/1973 | Cozzy et al. | 89/13 R X |

OTHER PUBLICATIONS

Technical Report, ADTC-TR-73-66, Sep. 1973, Fig. 14, (Eglin AFB) GAU-8/A Gun System.

*Primary Examiner*—David H. Brown
*Attorney, Agent, or Firm*—Bailin L. Kuch

[57] ABSTRACT

A feature of this invention is the provision for a Gatling type gun of a gun bolt of the oscillating head type having a gun bolt carriage with substantially radially projecting slides and a head with substantially radially projecting locking lugs, wherein the length of the radial projection of the slides is significantly greater than the length of the radial projection of the locking lugs.

1 Claim, 4 Drawing Figures

GUN BOLT FOR A HIGH RATE OF FIRE REVOLVING BATTERY GUN

BACKGROUND OF THE INVENTION

1. Field of Art

This invention relates to a gun bolt having an oscillating head for a Gatling type gun.

2. Prior Art

This classic modern revolving battery gun, as shown by R. J. Gatling in U.S. Pat. No. 125,563, issued Apr. 9, 1872, held its gun bolts in their locked disposition by means of the main helical cam. Improvements on the mechanism for locking the gun bolt are shoen by H. McC. Otto in U.S. Pat. No. 2,849,921, issued Sept. 2, 1958, including a bolt carriage having slides which ride in spaced apart tracks in the rotor, and an oscillatible bolt head having interrupted threads. The radial projection of these threads is less than the radial projection of the slides, taken from the longitudinal axis of the gun bolt. The M61Al Vulcan 20 mm gun does not have an oscillatible bolt head, it utilizes a pivoting lock bolt. The 7.62 mm Minigun as exemplified in U.S. Pat. No. 3,595,128, issued to J. P. Hoyt, Jr., on July 27, 1971 has an oscillatible bolt head having a single locking lug which projects radially beyond the grooves which serve as slides. In U.S. Pat. No. 3,611,871 issued to R. G. Kirkpatrick on Oct. 12, 1971, the gun bolt has a head with a plurality of locking lugs on a body which reciprocates in a splined tube, and which tube is oscillated, to oscillate the head. The radial projection of the locking lugs is greater than the radius of the bore which supports the tube. In U.S. Pat. No. 3,766,821, issued to T. W. Cozzy et al on Oct. 23, 1973, the gun bolt has a fully rotating roller which provides the locking lugs. These lugs have a radial projection which is substantially equal to the radial projection of the body which serves as the slide. In the GAU-8/A 30 mm gun described in Technical Report ADTC-TR-73-66 dated September 1973, the gun bolt, shown in FIG. 14, has a rotatable head with locking lugs which are substantially equal in radial projection to the slides.

Generally speaking, it is conventional to make the overall width of the gun bolt no greater than was necessary to provide a projection of the slides into the tracks beyond the width of the ammunition. This minimized the mass of the gun bolt and, therefore, the power required to drive the gun. However, it limited the maximum angle of the main cam track, and, therefore, it limited the minimum diameter of the main cam track.

SUMMARY OF THE INVENTION

It is an object of this invention to provide an improved gun bolt of the oscillating head type for a Gatling type gun which permits a reduction in the diameter of the main cam track beyond that conventionally available.

A feature of this invention is the provision for a Gatling type gun of a gun bolt of the oscillating head type having a gun bolt carriage with substantially radially projecting slides and a head with substantially radially projecting locking lugs, wherein the length of the radial projection of the slides is significantly greater than the length of the radial projection of the locking lugs.

BRIEF DESCRIPTION OF THE DRAWING

These and other objects, features and advantages of the invention will be apparent from the following specification thereof taken in conjunction with the accompanying drawing in which.

THE PREFERRED EMBODIMENT

Figure 1:
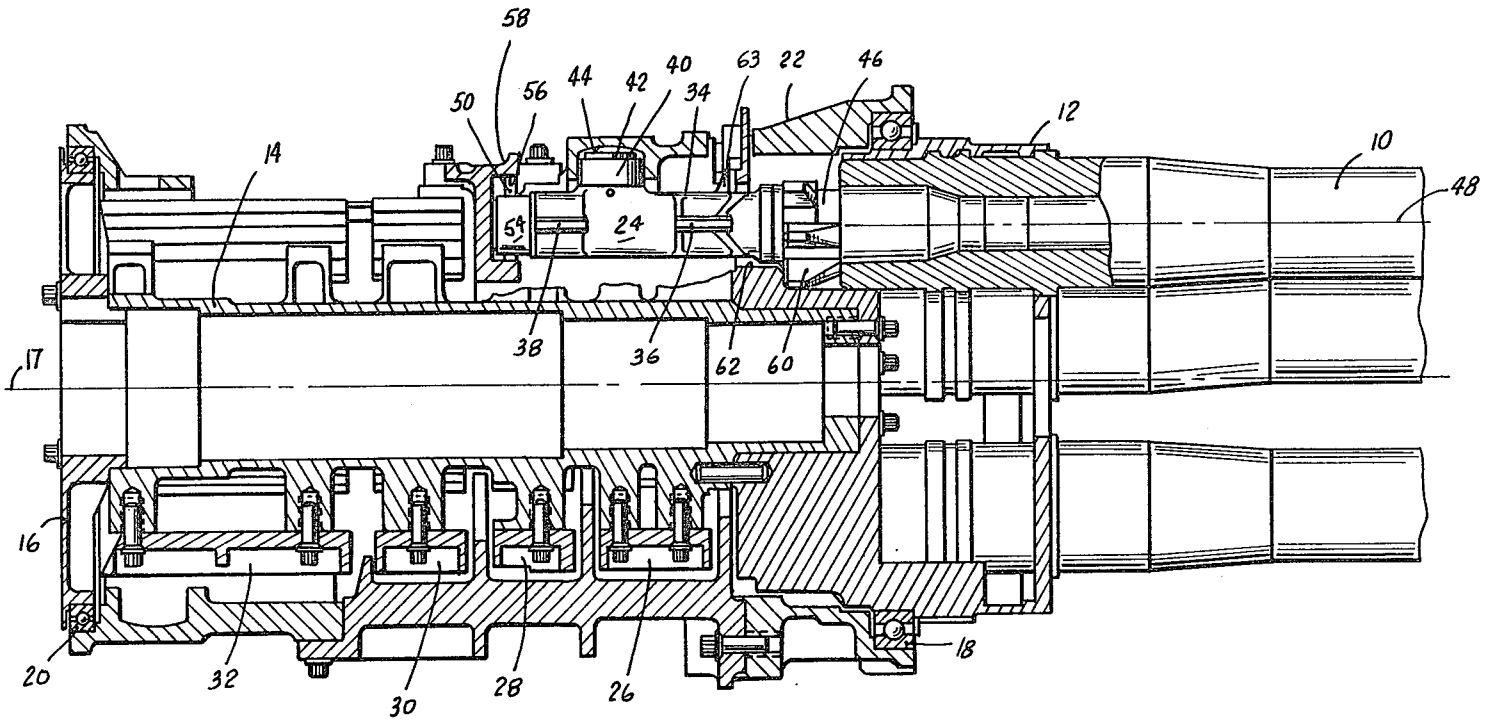
FIG. 1 is a longitudinal cross-section of a Gatling type gun having a gun bolt embodying this invention.
Figure 2:
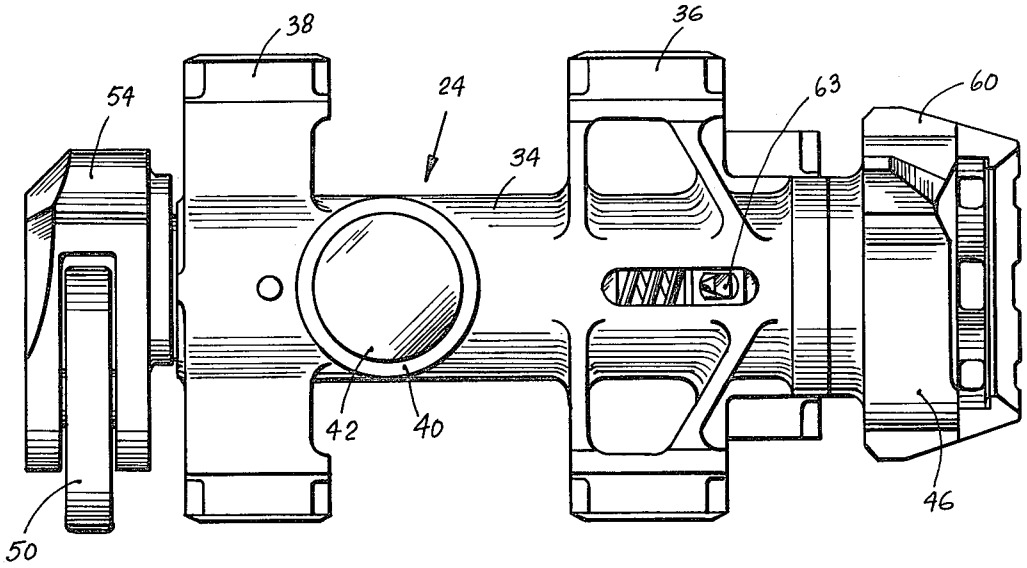
FIG. 2 is a top view of the gun bolt shown in FIG. 1.
Figure 3:
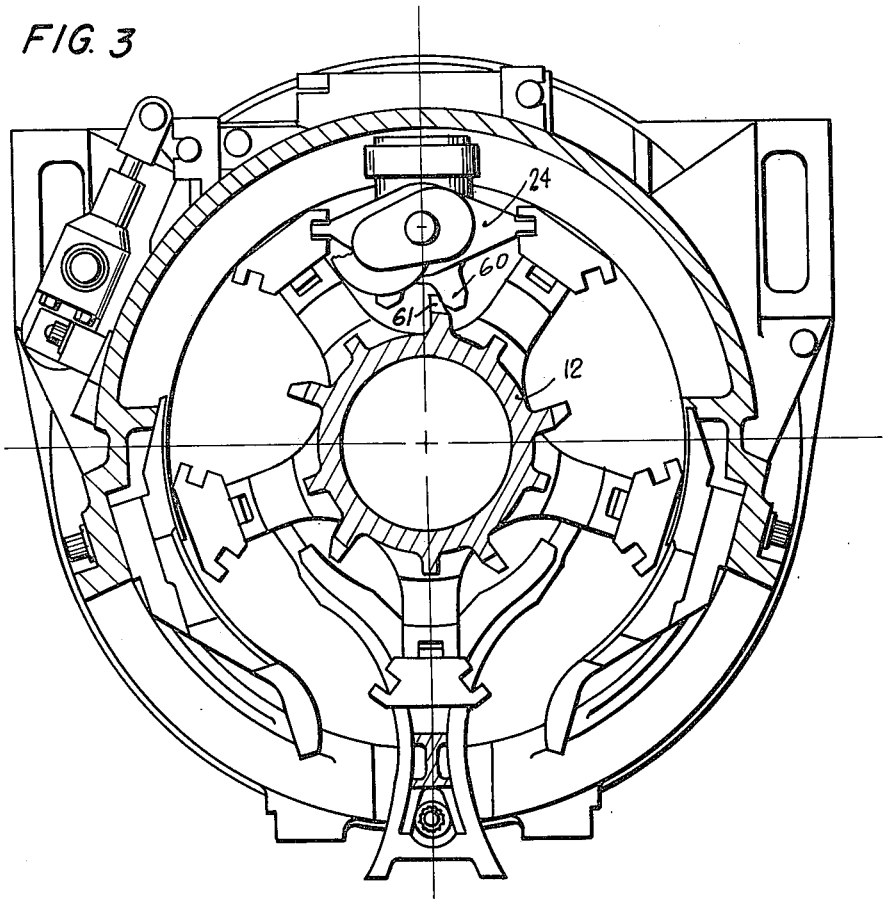
FIG. 3 is a transverse cross-section of the gun of FIG. 1.

The Gatling gun shown in FIG. 1 has a bolt locking system which is substantially of the type shown in U.S. Pat. No. 3,611,871 issued to R. G. Kirkpatrick et al on Oct. 12, 1971 and in the GAU-8/A gun described in Technical Report ADTC-TR-73-66 of September, 1973. Reference may be had to U.S. Pat. No. 3,611,871, the disclosure of which is hereby incorporated by reference for subject matter omitted herein. The gun bolt in U.S. Pat. No. 3,611,871 has a telescoping two-part body, while the gun bolt in the GAU-8/A gun, shown in FIG. 14 of the report, has a rigid body. In each case, the longitudinal reciprocation of the gun bolt is controlled by a stationary main cam track in the gun housing driving a cam follower or roller mounted to the gun bolt on a radial axis, and the locking and unlocking rotation of the head of the bolt is controlled by a stationary cam track in the gun housing driving a cam follower mounted to the gun bolt on an axis which is parallel to and spaced from the longitudinal axis of the gun bolt.

The gun includes a plurality, e.g., five, of gun barrels 10, fixed to a forward rotor 12, which is fixed to an aft rotor 14, which is fixed to an aft cover 16, and are all journaled for rotation about a longitudinal axis 17 by a forward bearing 18 and an aft bearing 20, in a stationary three-part housing 22. A plurality, e.g., five, of sets of tracks are bolted to the rotor, to receive between adjacent sets a like plurality of gun bolts 24. Each set includes tracks 26, 28, 30 and 32. Each gun bolt assembly 24 includes a bolt carriage 34 having slides 36, 38 which engage the tracks of the rotor. A gun bolt roller or cam follower 40 is journaled to a headed pin 42 which is fixed on a radial axis to the bolt carriage 34. This roller 40 rides in the main cam track 44 formed in the housing 22. As the rotor assembly 12, 14 rotates with its gun bolts 24, the main cam track 44 reciprocates the gun bolts to and between their forward and aft dwells. A breech bolt or bolt head 46 is journaled in the bolt carriage 34 for limited oscillation about its longitudinal axis 48. The bolt head has a plurality of radially projecting locking lugs 60, the side of one of which is engaged by an upstanding track portion 61 on the rotor 12, 14 when the bolt head is in the unlock angular position. This track portion precludes rotation of the bolt head with respect to the bolt carriage in the lock direction, except when the gun bolt is in front dwell, at which point the portion has terminated and does not engage the side of the lug. Rotation in the unlock direction beyond the unlock position is precluded by the cocking pin 63 passing through a wide slot in the bolt head and a narrow slot in the bolt carriage and engaging the side wall of the bolt head slot. A linear rotary motion roller 50 is journaled on a headed pin which is fixed to a cam follower 54 on an axis which is parallel to and spaced from the longitudinal axis of the bolt head. The cam follower is fixed to and coaxial with the bolt head. During front dwell of the gun bolt assembly the roller 50 engages a cam track 56 formed in a locking cam 58 which is fixed to the gun housing 46. As the rotor assembly rotates, the cam track 56 oscillates the bolt head 46 about is longitudinal axis 48 from unlock to lock to unlock, whereby the locking lugs 60 on the bolt head engage and disengage with the locking lugs 62 formed in the forward rotor 12 adjacent to the aft ends of the gun barrels 10.

The length of the radial projection of the slides 36, 38 from the longitudinal axis 48 of the gun bolt is significantly greater than the length of the radial projection of the locking lugs 60 from the axis 48.

The bolt of the gun is reciprocated in its supporting rotor tracks by the axial component of force generated by interaction between the driving roller of the bolt and the helical cam located in the gun housing. The lateral component of force generated by said interaction must be opposed by an equal and opposite lateral force between the gun bolt and the rotor track ways. Because the track ways are located radially inward from the cam of the gun housing, the aforesaid lateral forces form a couple which must be resisted by an equal and opposite couple formed by a pair of radial forces between the bolt and the rotor track ways. The radial forces, as well as the lateral force between bolt and rotor generate frictional resistance to axial motion of the bolt. Since the axial component of force between the helical cam and the bolt roller must at minimum be equal to the total of said frictional resistance, there exists a maximum operable helix angle for said cam. Said maximum helix angle, together with other functional requirements of the cam, determine a minimum operable diameter for the cam.

The lateral spacing between the pair of radial forces is conventionally comparable to the outside diameter of the bolt head. This invention provides a lateral spacing of approximately twice the conventional, thereby decreasing the magnitude of the radial forces between bolt and rotor tracks to one-half the conventional. Since the total of the lateral and radial forces between bolt and rotor is thereby reduced, the frictional resistance generated is reduced, and the minimum tolerable axis component of roller force is reduced. Reduction of the axial component of roller force relative to the lateral component increases the maximum operable helix angle and thereby reduces the minimum operable diameter for the gun.

Figure 4:
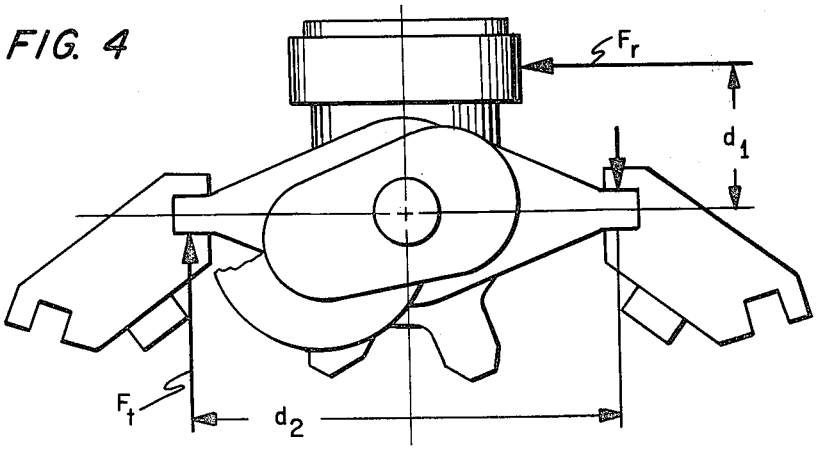
FIG. 4 is a diagram of forces affecting the gun bolt.

The advantage of widening the bolt tracks to the maximum extent possible may be explained by considering the forces acting on the bolt. FIG. 4 is a diagram taken through a cross-section perpendicular to the longitudinal axis of the bolt.

The component of force exerted by the wall of the main cam track on the bolt drive roller perpendicular to the longitudinal axis is designated as $F_r$.

This force tends to tip the bolt counterclockwise with a moment $F_r \times d_1$, where $d_1$ is the distance of the force above the track. The moment $F_r \times d_1$, often called the overturning moment, is resisted by a couple generated by track forces $F_t$. The magnitude of the couple for $F_t \times d_2$, where $d_2$ is the track width. Since the bolt must be in rotational equilibrium, $$F_r \times d_1 = F_t \times d_2$$

solving for $F_t$ $$F_t = F_r(d_1/d_2)$$

This expression shows that the track force is directly proportional to roller height and inversely to track width. Track force can be minimized, or conversely roller force maximized, by increasing track width $d_2$ and decreasing roller height $d_1$.

The friction which limits bolt motion and requires increased power input is generated by the track force, $F_t$. Friction should be decreased and roller load increased to achieve the smallest diameter main cam, and thereby the smallest diameter Gatling gun.

We claim:

1. A Gatling type gun including:

a housing, a rotor journaled in said housing for rotation about its longitudinal axis and having fixed thereto a plurality of pairs of tracks disposed in an annular row, the tracks of each of said pairs being mutually spaced apart by a first distance, and a like plurality of sets of locking lugs disposed in an annular row, a like plurality of gun bolts disposed in an annular row in said rotor and each disposed between the spaced apart tracks of a respective one of said pairs of tracks, each of said gun bolts including a bolt carriage having a pair of radially extending slides, each of said pair of slides being engaged with and supported by one of the tracks of a respective one of said pairs of tracks, a bolt head carried by, and journaled for oscillation about its longitudinal axis with respect to said bolt carriage and having a set of locking lugs for releasable engagement with a respective one of said plurality of sets of locking lugs of said rotor, each of the locking lugs of said set of locking lugs of said bolt head having a radial extension of a second distance which is less than one-half said first distance whereby each of said locking lugs of said bolt head in oscillation clears the adjacent tracks of said rotor which support the respective slides of the respective bolt carriage.

* * * * *